United States Patent [19]

Vernerey

[11] Patent Number: 4,898,315

[45] Date of Patent: Feb. 6, 1990

[54] EJECTOR SEALING APPARATUS

[75] Inventor: Jean-Claude Vernerey, Bourg-Les-Valence, France

[73] Assignee: Societe de Prospection et D'Inventions Techniques (S.P.I.T.), Bourg-Les-Valence, France

[21] Appl. No.: 178,709

[22] Filed: Apr. 7, 1988

[51] Int. Cl.[4] ..... B25C 1/14

[52] U.S. Cl. ..... 227/10; 227/9

[58] Field of Search ..... 227/8–10, 227/147; 42/25

[56] References Cited

U.S. PATENT DOCUMENTS

| | | | |
|---|---|---|---|
| 3,341,101 | 9/1967 | Butler et al. | 227/10 |
| 3,575,332 | 4/1971 | Brunelle | 227/10 |
| 3,804,315 | 4/1974 | Pomeroy | 227/10 |

*Primary Examiner*—Douglas D. Watts
*Assistant Examiner*—James L. Wolfe
*Attorney, Agent, or Firm*—Schwartz & Weinrieb

[57] ABSTRACT

A fastening apparatus with an improved ejector, is provided with a barrel (3) having a narrowed rear portion (15) upon which an ejection ring (5) may slide. The ring (5) includes two grooves (12, 12') for receiving a clip (22) cooperating with two milled portions (17, 18) of the barrel. The milled portions comprise a front land and a rear land separated by a rearwardly inclined ramp (19) for holding the ring (5), interlocked for translation with the barrel (3), in position until it comes into abuttment against a pawl (30) for retaining an inertia block (4), upon an opening of the apparatus, for proper ejection of a charge case (10).

8 Claims, 3 Drawing Sheets

EJECTOR SEALING APPARATUS

FIELD OF THE INVENTION

The present invention relates generally to a system within a power-actuated fastener projecting apparatus for driving a fixing a fixing element or fastener into a receiving material or support member by means of an inertia block movable under the influence of combustion gases of a charge contained within a case having a rim, and more particularly, to such type of apparatus which comprises, a barrel holder, a barrel mounted for slidable movement within the barrel holder and having a housing or bore for receiving the charge case, the inertia block being mounted within the barrel, a ring for ejecting the empty case comprising a rear bottom wall connected to a sleeve portion mounted for slidable movement within the barrel holder and having, in its bottom wall, a seat for receiving a rim portion of the charge case, a breech with a striker, disposed rearwardly of the bottom wall of the ejection ring, the sleeve and the ejection ring being mounted for slidable movement upon the barrel between a firing position, at which the bottom wall of the ring abuts against the rear face of the barrel, and a position for ejecting the case, at which a clip, integrally movable with the ring and adapted for cooperation by means of friction with the barrel, is disposed upon a rear portion of the barrel, and a slit formed within the barrel so as to extend axially thereof from a forward portion thereof to a rear portion thereof beyond a shoulder portion of the barrel which is engageable by means of the ejecting ring so that a pawl may, during the opening of the apparatus, project through the slit and into the barrel and retain the inertia block therein.

Thus, within this sealing apparatus, the clip which is secured to the ejection ring must forcibly slide upon the barrel between a forward position and a rearward position.

Preparation of the sealing apparatus so as to obtain the firing position is achieved by pressing it against the receiving material. The barrel is thus pushed rearwardly and moves with it, through means of the clip, the ejection ring until its bottom wall abuts against the breech which occurs before the end face of the barrel abuts against the bottom wall of the ring, whereby it obtains the firing or locked position.

After firing, the apparatus is opened, the barrel having been driven forwardly. Because of the frictional forces of the clip of the ejection ring upon the barrel, the ring normally follows the barrel during its forward movement until the barrel abuts against the retaining pawl for the inertia block which passes through the slit which is defined within the barrel. With the barrel continuing its normal forward movement, the ejection ring will normally be detached from the barrel, against the action of the frictional forces of the clip upon the barrel and, by means of the aforenoted rim, retains the case of the charge which is thus disengaged from its housing bore defined within the barrel, which in practice is slightly tapered. The barrel continues its forward motion until the rear wall portion of the barrel defining the slit for passage of the pawl therethrough is in turn abutted by means of the pawl.

BACKGROUND OF THE INVENTION

Approximately, from the beginning of the opening of the apparatus, the pawl projecting into the barrel retains the inertia block therein. With the barrel driven forwardly, the immobilized inertia block in effect moves backwards relative to the barrel, the space between the rear end of the inertia block and the inner bottom wall of the case decreases and the gases present within this space are compressed by means of the inertia block so as to normally cause the case to be ejected from its housings defined within the barrel and the ring.

However, and more particularly because of residual combustion particles, the ejection ring which normally follows the barrel during the beginning of its forward movement may be stopped within the barrel holder before it abuts the pawl as a result of the resistance of the particles being greater than the frictional forces of the clip upon the barrel. The result is a relative backward movement of the ejection ring with respect to the barrel whereby the above mentioned space remains too large and is not properly sealed in order to permit the gases to be sufficiently compressed and to therefore be able to properly eject the case.

The present invention aims at overcoming the aforenoted drawback and provides a power tool apparatus characterized by means of a reliable and efficient case ejection or with a perfected ejector.

SUMMARY OF THE INVENTION

To this end, the present invention provides a power-actuated fastening apparatus of the above mentioned type, wherein means are provided for increasing the resistance with respect to the rearward sliding of the clip upon the barrel, from the firing position of the ejection ring.

With the invention, the operator of the fastening apparatus is certain that the ejection ring is only disengaged from the barrel and the case is therefore only disengaged from its housing within the barrel from the moment when the ring abuts the inertia block retaining pawl.

It will be noted that the means for increasing the resistance with respect to the rearward sliding of the clip upon the barrel which is only of concern with the region rearwardly of the rear shoulder of the barrel, only plays a role in one direction, namely rearwardly. Otherwise, if the resistance with respect to the rearward sliding of the clip upon the barrel were also increased in the other direction, namely forwardly, this resistance would potentially be greater than the pressing resistance of the apparatus and might in such case cause the operator to believe that his apparatus is effectively pressed in position, when such would not be the case, at the time the operator is ready to actuate the trigger.

In the preferred embodiment of the fastening apparatus of the invention, the means for increasing the resistance with respect to the reward sliding of the clip includes at least one ramp formed upon the barrel, in front of its rear shoulder, and slanted outwardly towards its rear portion thereof.

In this case the barrel of the fastening apparatus of the invention comprises two laterally spaced stepped milled portions each of which extends axially between two radially extending shoulders in the form of a circular skull cap defined upon each side of the inclined ramp.

BRIEF DESCRIPTION OF THE DRAWINGS

The invention will be better understood from the following description of the fastening apparatus of the invention with reference to the accompanying drawings in which.

DETAILED DESCRIPTION OF THE ILLUSTRATED EMBODIMENTS

Figure 1:
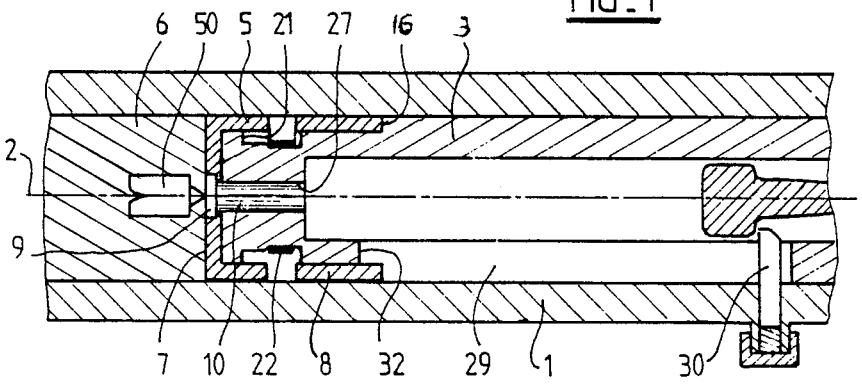
Fig 1 is an axial sectional view of the apparatus of the invention, shown in the firing position.

The indirect firing fastening apparatus shown in the Figs. is used for introducing, by means of an inertia block, a fixing element, such as, for example, a nail, screw, peg, or the like into a receiving material such as, for example, concrete or any other metal or the like. It is a question, apart from the specific characteristics of the invention, of a conventional apparatus well known by a man skilled in the art. For this reason only the elements which are indispensable to an understanding of the invention and of putting the invention into practice will be described hereafter.

The apparatus comprises a barrel holder 1, a barrel 3 mounted for translational movement within the barrel holder, an inertia block 4 mounted for translational movement within the barrel, an ejection ring 5 mounted for translational movement within the barrel holder and upon the barrel, and a breech with a striker 50 mounted within the barrel holder. All of these elements have a common axis 2.

The ejection ring 5 includes a rear bottom wall 7 and an axially extending sleeve portion 8 having an external diameter which is substantially equal to the internal diameter of the barrel holder 1. Bottom wall 7 is provided with an orifice for receiving the rim 9 of the propulsive charge case 10 and the portion of the case adjacent to the rim.

The sleeve portion 8 of ring 5 after being machined so as to form a circumferential annular groove 11 of U-shaped section, is milled, symmetrically upon each side of an axial plane, so as to form on each side two diametrically extending planar portions, 12, 12' spaced apart by means of the width of a clip, which will be discussed hereafter, and the planes 13 being dispose parallel to the axial plane in question, at a distance from axis 2 which is less than the internal radius of the sleeve portion 8 of the ring 5.

Figure 4:
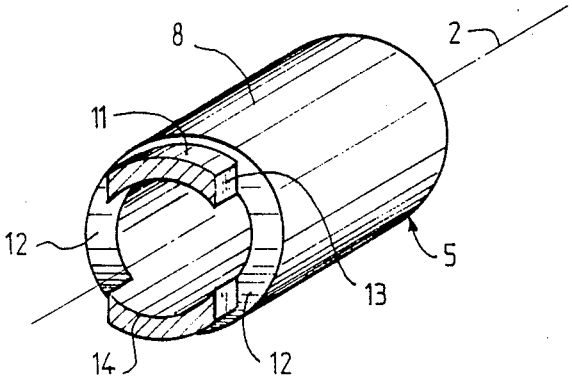
FIG. 4 is a truncated perspective view of the ejection ring of the apparatus shown in FIG. 1.
Figure 3:
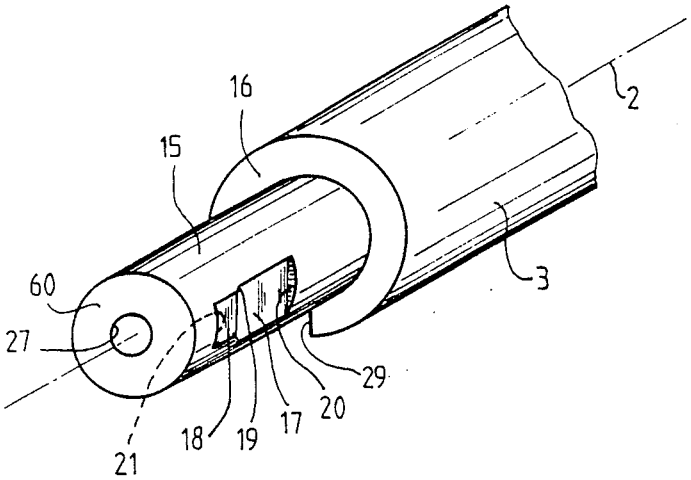
FIG. 3 is a perspective view of the rear part of the barrel of the apparatus of FIG. 1.

Planes 12, 12', and 13 form two symmetrical laterally spaced groove spaced apart from each other by means of a distance less than the internal diameter of the ring. FIG. 4 is a perspective view in section through a plane disposed perpendicular to axis 2, with the rear part of the ring, with its bottom wall, deleted and FIG. 1, is for example, a sectional view through an above mentioned axial plane.

The barrel 3 includes a rear portion 15 having a narrowed external diameter, between its rear face 60 and a forward radial annular shoulder 16 and having an axial length substantially equal to that of the sleeve portion 8 of the ring 5. A through bore 27 for receiving the largest part of the case 10 is formed within the rear of the narrowed portion 15 of the barrel. The bore 27 is slightly tapered.

The narrow portion 15 of the barrel 3 comprises upon each side thereof, and symmetrically with respect to the same axial plane mentioned above, two flat adjacent , milled portions 17, 18 forming a stepped milling, upon each side of a ramp 19 which is inclined outwardly and rearwardly, and between two radial shoulders 20, 21 in the form of an arcuate skull cap. The lands 17, disposed parallel to the axial plane in question, are spaced apart from axis 2 by means of a distance substantially greater than that separating the planes 13 of the ejection ring from axis 2, and lands 18 are spaced apart from each other by means of a slightly greater distance. The forward shoulders 20 are spaced rearwardly from the forward shoulder 16 by means of substantially the same axial distance as that of planes 12 with respect to the forward end of the ejection ring 5. Lands 17 extend axially over the same distance as that separating the planes 12, 12' of the ejection ring 5, namely the width of the clip 22.

Figure 5:
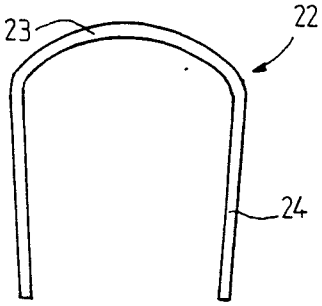
FIG. 5 is a schematic view of the clip of the ejection ring of FIG. 4.
Figure 7:
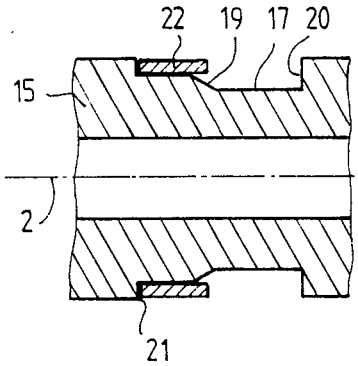
FIGS. 6, 7 are two axial sectional views of the first embodiment of the barrel portion upon which the ejection ramps are formed, in the firing and ejection positions respectively.
Figure 6:
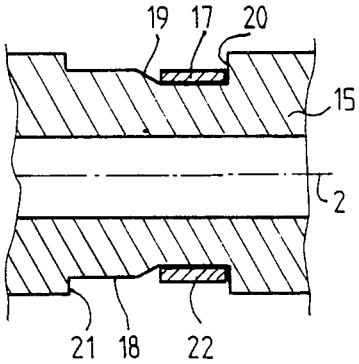

The resilient clip 22, mentioned above, having a general U-shape with a circular cross piece 23 and two legs 24, is mounted by means of its cross piece within groove 11 of the ejection ring 5 and by means of its legs in the lateral grooves thereof. The internal surfaces of the legs of the clip are flat (FIGS. 5, 6, 7). In the ready for firing and firing position shown in FIG. 1, clip 22 is slightly force fitted upon the lands 17 of the barrel 3.

In this same firing position, case 10 is wholly engaged within its housing bores defined within the ejection ring 5 and the barrel 3, the front end of the case being disposed only slightly rearwardly of the forward end opening of the housing bore 27.

The inertia block 4 has a rear head 28 having an external diameter which is substantially equal to the internal diameter of the barrel and forming a retaining shoulder 31. A slit 29 is formed within the lower part of the barrel, substantially within the axial plane mentioned above, with a width substantially equal to that of a spring mounted pawl 30 projecting radially through the barrel holder and adapted so as to retain the inertia block by means of its shoulder 31 when the apparatus is opened after firing. The rearwardly disposed radially extending portion 32 of slit 29 is disposed rearwardly beyond the forward shoulder 16 of the barrel 3 by means of a distance which may be termed the ejection distance.

With the parts of the fastening apparatus thus described, its operation may now be explained.

Under the action of the combustion gases of the charge contained within case 10, the inertia block 4 is propelled forwardly within the barrel 3, driving the fixing element into the receiving material.

After firing, the parts of the apparatus are in the position shown in FIG. 1, with the bottom wall 7 of the ejection ring 5 abutting against the rear face 60 of barrel 3. The apparatus is opened by driving barrel 3 forwardly, the inertia block 4 being retained by pawl 30 projecting into the barrel by means of slit 29, that is to say that the inertia block is driven relatively rearwardly within the barrel, compressing the residual combustion gases between the leading end of case 10 and the rear face of inertia block head 28. With case 10 engaged with the walls of housing bore 27 of the barrel under the pressure of the propulsion gases, the compression gas pressure of the residual combustion gases thus created is not sufficient to disengage the case from the housing bore 27 in the barrel.

Figure 2:
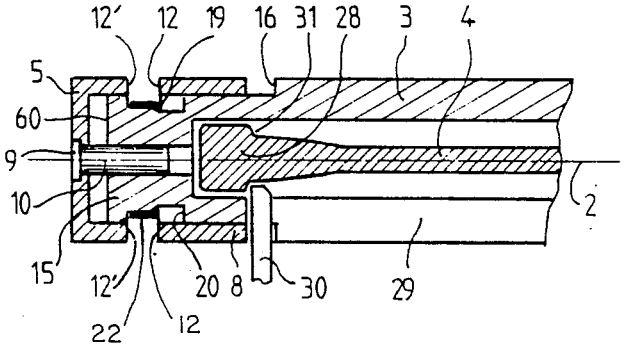
FIG. 2 is an axial sectional view of the apparatus of FIG. 1, shown in the open position for ejection of the propulsive charge case.

Because of the frictional cooperation of the clip 22 and the lands 17 of the barrel, the ejection ring 5, interlocked with clip 22 whose legs 24 are housed in grooves 12, 12', 13 of the ring, follows the barrel within its forward movement. If residual combustion particles create a frictional force between ring 5 and the barrel holder 1, the ramps 19 of the barrel increase the resistance to sliding of clip 22 and prevent it from sliding rearwardly over the barrel. Thus, the ejection ring 5 continues its forward movement with the barrel, until it abuts against the retaining pawl 30. At that moment, and with the barrel continuing its forward movement ring 5 moves translatably rearwardly with respect to the barrel 3 and case 10, held by ring 5 is likewise moved rearwardly with respect to housing bore 27, clip 22 riding over ramps 19 until the rear portion 32 of the barrel slit comes into abutment against pawl 30, the forward driving force of the barrel being sufficient to overcome the resistance exerted by means of clip 22 upon ramps 19 and lands 18. The open or ejection position is then reached. At the same time, the pressure of the gases created by means of the relative backward movement of the inertia block is sufficient to partially disengage the case 10, with its rim 9, from its housing bore 27 defined within the ring and to partially eject it (FIG. 2).

To prepare the apparatus for firing, it is pressed against the receiving material. Barrel 3 is thus pushed rearwardly into the barrel holder 1, taking ring 5 with it, as a result of the disposition of clip 22, until the ring abuts against the breech 6. The barrel continues its rearward travel somewhat, until its rear face 60 abuts against the bottom wall 7 of the ring, the firing or locked position then being attained.

In the embodiment shown in FIGS. 1, 2, 3, 6, 7, the rear lands 18 of the barrel are substantially shorter than the front lands 17, that is to say, the length of the lands 18 is shorter than the width of the flat legs 24 of the clip 22. That is not important; in the open or ejection position, the legs of clip 24 extend beyond ramps 19, as seen in FIG. 7.

Figure 9:
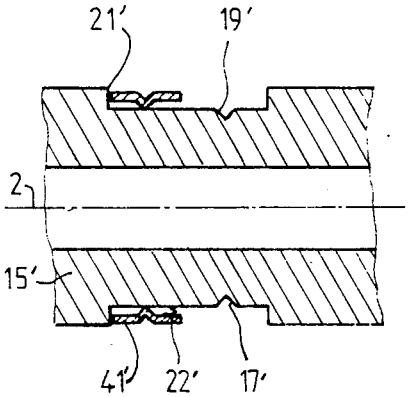
FIGS. 8, 9 are two axial sectional views of a second embodiment of the barrel portion upon which the ejection ramps are formed, in the firing and ejection positions, respectively.
Figure 8:
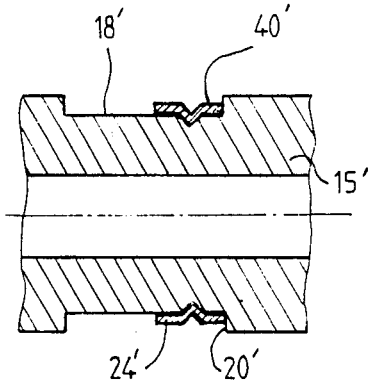

In the embodiment shown in FIGS. 8, 9, the front lands are replaced by means of grooves 17', with a V section, one of the sides of which is formed by means of the corresponding ramp 19', increasing the frictional resistance between the clip and the barrel portion 15' as required. In this embodiment, legs 24' of clip 22' no longer have a substantially rectangular section, but a V shaped section, complementary to that of the grooves 17', which are laterally extended upon both sides thereof by means of a flange, one of which 40', when the legs of the clip are disposed within the grooves, is in abutment against the associated forward shoulder 20'. The other flange 41' of the legs of the clip has a width less than that of lands 18', which are provided so that the legs of the clip may be disengaged from the grooves 17' and be translated along barrel portion 15'.

An ejection ring has been described with two grooves for receiving the legs of the clip, with portions 13 parallel to the axial plane of symmetry. The reception grooves could be slanted with respect to this plane , so as to improve fixation of the clip upon the ring. Similarly, the lands of the milled portions of the barrel could also be slanted with respect to this same plane of symmetry.

Obviously, many modifications and variations of the present invention are possible in light of the above teachings. It is therefore to be understood that within the scope of the appended claims, the present invention may be practiced otherwise than as specifically described herein.

I claim:

1. Apparatus for driving a fixing element or fastener into a receiving material, comprising:

a barrel holder (1);

a barrel (3) slideably disposed within said barrel holder (1) between a firing position and an open-ejection position;

means defining a housing bore (27) within said barrel (3);

inertia block means (4) movably disposed within said barrel (3) between a firing position and a fired position for driving said fixing element or fastener into said receiving material;

pawl means (30) projecting radially inwardly through a sidewall portion of said barrel holder (1) and said barrel (3) for engaging said inertia block means (4) when said inertia block means (4) is moved to said fired position so as to retain said inertia block means (4) within said barrel (3);

axially extending slit means (29) defined within said sidewall portion of said barrel (3) for housing said pawl means (30) so as to permit said barrel (3) to move axially relative to said barrel holder (1) and said pawl means (30) from said firing position to said open-ejection position;

a propulsive charge case (10), having a flanged rim portion (9), disposed within said housing bore (27) of said barrel (3) for generating propulsive gases for propelling said inertia block means (4) toward said fired position from said firing position;

breech means (6), and striker means (50) disposed within said breech means (6), for transmitting an impact force to said propulsive charge case (10) so as to cause said propulsive charge case (10) to generate said propulsive gases;

ejection ring means (5), comprising an end wall (7) within which said rim portion (9) of said propulsive charge case (10) is housed and a sleeve portion (8) mounted upon said barrel (3), movably mounted upon said barrel (3) between a first firing position and a second ejection position for ejecting said propulsive charge case (10) from said barrel (3) when said ejection ring means (5) and said barrel (3) are moved to said open-ejection position;

clip means (22,22') interconnecting said ejection ring means (5) and said barrel (3) together and movable with said ejection ring means (5) relative to said barrel (3) between said first firing position and said second ejection position; and means (19,19') for increasing the resistance of said movement of said clip means (22,22') relative to said barrel (3) between said first firing position and said second ejection position.

2. Apparatus according to claim 1, wherein:

said means for increasing said resistance to said movement of said clip means (22,22') relative to said barrel (3) comprises at least one ramp (19,19') formed upon said barrel (3) between a rear shoulder portion (21,21') and a forward shoulder portion (20,20') and inclined radially outwardly and axially towards said rear shoulder portion.

3. Apparatus according to claim 2, wherein:

said barrel (3) comprises a stepped milled portion defined by two lands (17,18) disposed upon opposite sides of said ramp (19) and between said forward shoulder portion (20) and said rear shoulder portion (21), said rear land (18) being disposed further away from the axis (2) of said barrel (3) than said front land (17), and said clip (22) being provided with legs (24) having a substantially rectangular cross-section.

4. Apparatus according to claim 3, wherein the width of the legs (24) of the clip (22) is substantially equal to the axial length of the front land (17) between said forward shoulder (20) and the ramp (19).

5. Apparatus according to claim 4, wherein the sleeve (8) of the ejection ring (5) includes a radial and circumferential annular groove (11) for receiving a circular cross piece (23) of the clip, between two grooves (12, 13) for receiving the legs of the clip (22; 22'), spaced apart from each other by a distance less than the internal diameter of the ring (5).

6. Apparatus according to claim 2, wherein the barrel (3) comprises a milled portion including a radial groove (17') with a V section followed by a rear land (18'), the rear side of the groove (17') forming the ramp (19'), and the clip (22') is provided with legs (24) with a V section complementary to that of the groove (17'), axially extended upon opposite sides thereof, by two flanges (40', 41').

7. Apparatus according to claim 6, wherein the sleeve (8) of the ejection ring (5) includes a radial and circumferential annular groove (11) for receiving a circular cross piece (23) of the clip, between two grooves (12, 13) for receiving the legs of the clip (22; 22'), spaced apart from each other by a distance less than the internal diameter of the ring (5).

8. Apparatus according to claim 1, wherein the sleeve (8) of the ejection ring (5) includes a radial and circumferential annular groove (11) for receiving a circular cross piece (23) of the clip, between two grooves (12, 13) for receiving the legs of the clip (22; 22'), spaced apart from each other by a distance less than the internal diameter of the ring (5).

* * * * *